US009533815B2

(12) United States Patent
Hu

(10) Patent No.: US 9,533,815 B2
(45) Date of Patent: Jan. 3, 2017

(54) TRAY HAVING LIMITING STRUCTURES

(71) Applicant: Shenzhen China Star Optoelectronics Technology Co., Ltd., Shenzhen, Guangdong (CN)

(72) Inventor: Qianshuang Hu, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 274 days.

(21) Appl. No.: 13/979,649

(22) PCT Filed: Jun. 24, 2013

(86) PCT No.: PCT/CN2013/077812

§ 371 (c)(1),
(2) Date: Jul. 13, 2013

(87) PCT Pub. No.: WO2014/180029

PCT Pub. Date: Nov. 13, 2014

(65) Prior Publication Data

US 2014/0332422 A1 Nov. 13, 2014

(30) Foreign Application Priority Data

May 9, 2013 (CN) ..... 2013 1 0169654

(51) Int. Cl.
*B65D 81/05* (2006.01)
*B65D 85/48* (2006.01)

(52) U.S. Cl.
CPC ..... *B65D 81/05* (2013.01); *B65D 85/48* (2013.01)

(58) Field of Classification Search
CPC ..... B65D 81/05; B65D 81/053; B65D 85/48; G02F 1/133308; G02F 1/133608
USPC ..... 203/454, 320, 455, 456, 449, 586, 447, 203/480, 451; 349/58; 206/454, 320, 455, 206/456, 449, 586, 447, 480, 451
See application file for complete search history.

(56) References Cited

U.S. PATENT DOCUMENTS

| | | | | | |
|---|---|---|---|---|---|
| 3,939,978 | A * | 2/1976 | Thomaswick | 206/454 | |
| 4,427,114 | A * | 1/1984 | Howell et al. | 206/707 | |
| 4,767,984 | A * | 8/1988 | Bakker | 324/756.02 | |
| 5,076,432 | A * | 12/1991 | Wolf | B65D 5/5021 | 206/449 |
| 5,348,489 | A * | 9/1994 | Yeh | 439/153 | |
| 5,518,118 | A * | 5/1996 | Putz et al. | 206/449 | |
| 6,918,779 | B2 * | 7/2005 | Liao | 439/342 | |
| 7,510,427 | B2 * | 3/2009 | Szu | 439/526 | |
| 7,581,639 | B2 * | 9/2009 | Chiu | G03F 1/66 | 206/454 |

(Continued)

FOREIGN PATENT DOCUMENTS

| | | |
|---|---|---|
| CN | 201116174 Y | 9/2008 |
| CN | 102923394 A | 2/2013 |

*Primary Examiner* — Steven A. Reynolds
(74) *Attorney, Agent, or Firm* — Andrew C. Cheng

(57) ABSTRACT

A tray having limiting structures for positioning an open cell LCD panel is disclosed. The tray includes a main body of tray. The main body of tray has a recess for positioning the open cell LCD panel. The main body of tray further includes locking members. Each of the locking members is constituted by a fixed part connecting to the main body of tray and a snap-fit part flexibly connecting to the fixed part. The locking member is connected to the main body of tray through adhesive. The locking member can be mounted when it is used and removed when not used. The compatibility of the tray is expanded.

5 Claims, 4 Drawing Sheets

(56) References Cited

U.S. PATENT DOCUMENTS

| | | | | |
|---|---|---|---|---|
| 7,644,820 | B2 * | 1/2010 | Hohne | B65D 81/053 206/449 |
| 9,038,824 | B2 * | 5/2015 | Zhao | 206/454 |
| 2008/0128310 | A1 * | 6/2008 | Kao et al. | 206/521 |
| 2013/0156537 | A1 * | 6/2013 | Lo et al. | 414/800 |
| 2014/0069834 | A1 * | 3/2014 | Kuo et al. | 206/454 |
| 2014/0311935 | A1 * | 10/2014 | Yue et al. | 206/454 |
| 2014/0340610 | A1 * | 11/2014 | Hu | 349/58 |

* cited by examiner

TRAY HAVING LIMITING STRUCTURES

BACKGROUND OF THE INVENTION

1. Field of the Invention

The present invention relates to a tray for positioning an open cell liquid crystal display (LCD) panel, more particularly, to a tray having limiting structures.

2. Description of the Related Art

Nowadays, LCD panels are packaged in different ways. Some of them are mainly packaged with plastic discs, some of them are mainly packaged with injection boxes, and some of them are mainly packaged with foam products. LCD panels exist in two forms, which are cell type and open-cell type as defined by the industry. A cell LCD panel is a liquid crystal box formed by disposing liquid crystal molecules between two glass substrates, and its appearance is not different from the ordinary sheet glass. An open cell LCD panel is formed by disposing various ports on the cell LCD panel so that external signal sources are allowed to be connected. However, the open cell LCD panel does not comprise components such as backlight, bezel, etc. which always exist in the liquid crystal module (LCM).

Usually, more than one PC boards (PCBs) of the open cell LCD panel are connected by a flexible sheet. Such a flexible sheet, called as a chip-on-film (COF), is distributed with circuit to bridge signals between the open cell LCD panel and the PCBs. The open cell LCD panel is usually placed in a tray and kept flat, and the positioning devices of the tray are used for positioning the periphery of the open cell LCD panel. When the open cell LCD panel is subject to vibration, the PCBs tend to displace and pull the COF to cause damage to it. Hence, the product quality is impacted. Furthermore, since the COF is a flexible sheet, the PCBs tend to be carried into the gap between two liquid crystal boxes owing to the vibration. In the current packaging method for the open cell LCD panels, columns are directly formed when the plastic disc tray is formed. As shown in FIG. 1 and FIG. 2, an open cell LCD panel A 1 only has one COF 2, and two columns 5 of the tray 4 are used for stopping a PCB 3. Such a method is only suitable for a single tray for accommodating a very few open cell LCD panels. Once the number of the open cell LCD panels is large, the column 5 becomes taller. Due to the blockage of the columns 5, the PCB 3 tends to be hung on the columns 5 when placing and displacing the open cell LCD panel. As a result, the COF 2 is pulled and damaged to impact product quality. The capacity for the current used tray is four, and the columns 5 are simultaneously formed when the tray 4 is produced. Consequently, the universality of the tray 4 is questionable. In addition, please also refer to FIG. 3, if the tray 4 is intended to be used for accommodating an open cell LCD panel B 6 that has a plurality of COFs connecting with a PCB 8, the two centered COFs 7 will collide with the two columns 5 of the tray 4. The tray 4 is therefore not able to accommodate the open cell LCD panel B 6. For a tray being able to do so, a new mold needs to be made to fabricate trays for the open cell LCD panels B 6. As a result, the cost of the mold is a waste. Moreover, since the trays are used repeatedly, the package resource is also wasted to increase production cost if they are not applied universally.

SUMMARY OF THE INVENTION

The present invention provides a tray compatible with various open cell liquid crystal display panels to resolve the above-mentioned problems.

The present invention provides a tray having limiting structures for positioning an open cell liquid crystal display panel. The tray comprises a main body of tray. The main body of tray has a recess for positioning the open cell liquid crystal display panel. The main body of tray further comprises locking members. Each of the locking members is constituted by a fixed part connecting to the main body of tray and a snap-fit part flexibly connecting to the fixed part. The damages to the COF caused by packaging, placing, and displacing are prevented by limiting the PCB with the snap-fit part.

In one aspect of the present invention, the snap-fit part is hinged to the fixed part.

In another aspect of the present invention, opposite ends of the snap-fit part and the fixed part are staggeredly hinged, a hinge hole is disposed in the plug portion, and a hinge axis is inserted into the hinge hole.

In another aspect of the present invention, one end of the fixed part is fixedly connected to an inner wall of the main body of tray through adhesive, and the snap-fit part comprises a connection portion and a snap portion that are integrally connected to each other and angled to each other.

In another aspect of the present invention, an anti-static buffer sheet is disposed on an outer surface of the snap portion.

In another aspect of the present invention, anti-static buffer sheets are disposed on inner side walls of the main body of tray which is connected to the liquid crystal box.

In contrast to the prior art, the locking member is connected to the main body of tray through adhesive according to the present invention. The locking member can be mounted when it is used and removed when it is not used. The compatibility of the tray is thus expanded to fulfill the packaging requirements for the open cell LCD panel A and the open cell LCD panel B. The locking member may be mounted after the open cell LCD panels are put in stack. When the snap-fit parts of the locking members are engaged in the gaps between the PCB and the liquid crystal box on both sides of the COF, the PCB is limited. Hence, the damages to the COF caused by vibration of the PCB during transportation are prevented. The hinge axis of the snap-fit part may be lifted before the open cell LCD panel is displaced. Under the circumstances, the PCB and the COF are in a relatively open state so the open cell LCD panel is not hindered due to external factors when the open cell LCD panel is taken to be used. For example, the columns in the main body of tray according to the prior art are possible to hinder the PCB so as to damage the COF. The anti-static buffer sheets disposed on the locking member and the main body of tray can further protect the liquid crystal box.

DESCRIPTION OF THE EMBODIMENTS

The accompanying drawings are included to provide a further understanding of the invention, and are incorporated in and constitute a part of this specification. The drawings illustrate embodiments of the invention and, together with the description, serve to explain the principles of the invention.

Embodiment 1

Figure 4:
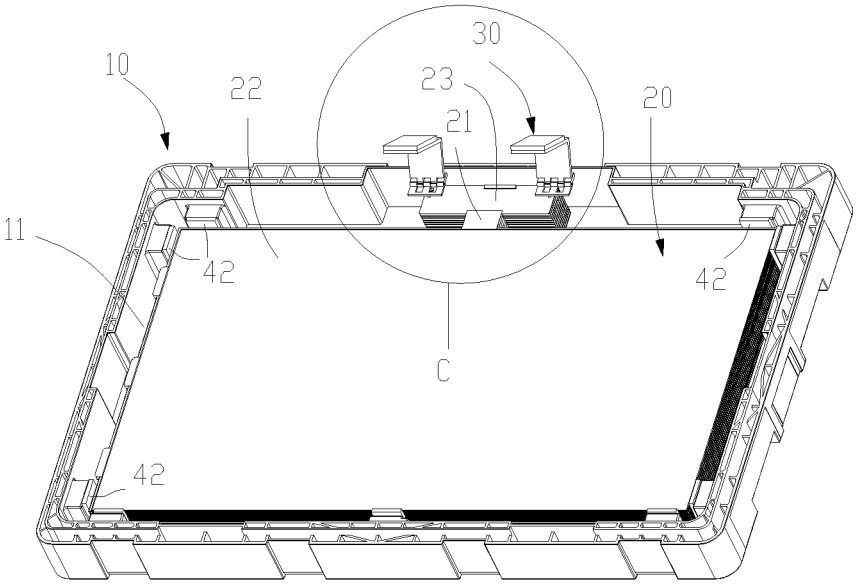
FIG. 4 is a schematic diagram showing a tray having limiting structures according to a first embodiment of the present invention.
Figure 5:
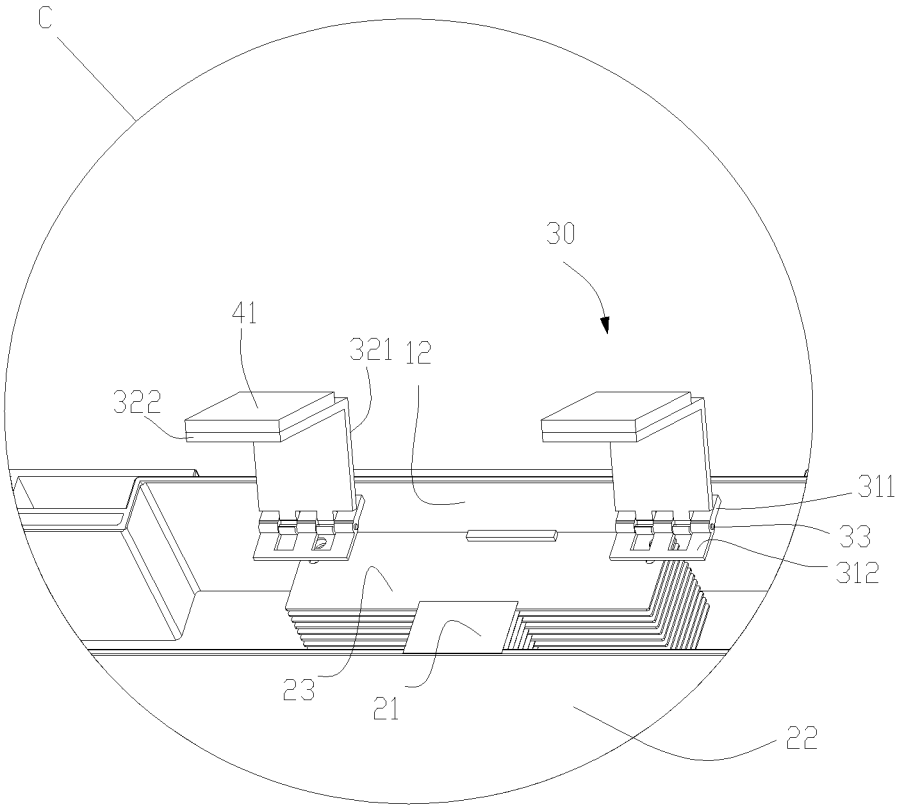
FIG. 5 is an enlarged view of portion C depicted in FIG. 4.
Figure 6:
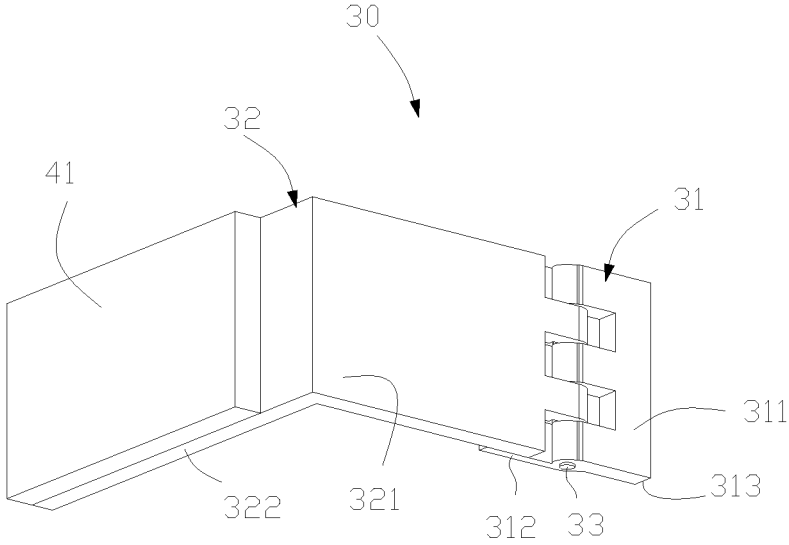
FIG. 6 is a schematic diagram showing a structure of a locking member according to the first embodiment of the present invention.

As shown in FIG. 4 and FIG. 5, a tray used for positioning an open cell LCD panel comprises a main body of tray 10. The main body of tray 10 has a recess 11 for positioning the open cell LCD panel, and an open cell LCD panel A 20 is placed in the recess 11. The open cell LCD panel A 20 is formed by connecting a liquid crystal box 22 and a PCB 23 with a COF 21. The main body of tray 10 further comprises locking members 30. Please also refer to FIG. 6, the locking member 30 is constituted by two components, namely a fixed part 31 and a snap-fit part 32 which are mutually hinged to each other. The fixed part 31 comprises a fixed portion 311 and a receiving portion 312. The fixed portion 311 and the receiving portion 312 are integrally formed and in a shape of a step. The snap-fit part 32 is hinged to the step. The snap-fit parts 32 rotate towards the receiving portions 312 and finally adhere to the surfaces of the receiving portions 312 so that the snap-fit parts 32 will not directly press on the PCB 23, and the two locking members 30 at two sides of the PCB 23 have uniform effects. Opposite ends of the snap-fit part 32 and the fixed part 31 are staggeredly hinged (similar to the manner in which the door pivot is hinged). A hinge hole is disposed in the plug portion, and a hinge axis 33 is inserted into the hinge hole to hinge the snap-fit part 32 to the fixed part 31. A side 313 of the fixed portion 311 is coated with adhesive to allow the locking member 30 be mounted to an inner wall 12 of the main body of tray 10 (please refer to FIG. 5). The reason to utilize adhesive is that the locking member 30 can be removed at any time when it is not used. The snap-fit part 32 comprises a connection portion 321 and a snap portion 322 that are integrally connected to each other and angled to each other. When the snap-fit parts 32 rotate and adhere to the receiving portions 312 of the fixed parts 31, the connection portions 321 adhere to the receiving portions 312 and the snap portions 322, being perpendicularly connected to the connection portions 321, are inserted into two sides of the COF 21 of the open cell LCD panel A 20 according to the present embodiment. That means, each of the two locking members 30 is engaged in the corresponding gap of the two gaps between the PCB 23 and the liquid crystal box 22 so as to limit the PCB 23. Hence, the COF 21 will not be damaged during transportation, loading, and unloading. At the same time, as shown in the figures, an anti-static buffer sheet 41 is disposed on an outer surface of the snap portion 322 which is a side facing the liquid crystal box 22. Furthermore, anti-static buffer sheets 42 are disposed on inner side walls of the main body of tray 10 which is connected to the liquid crystal box 22 to increase the protection for the liquid crystal box 22.

Figure 1:
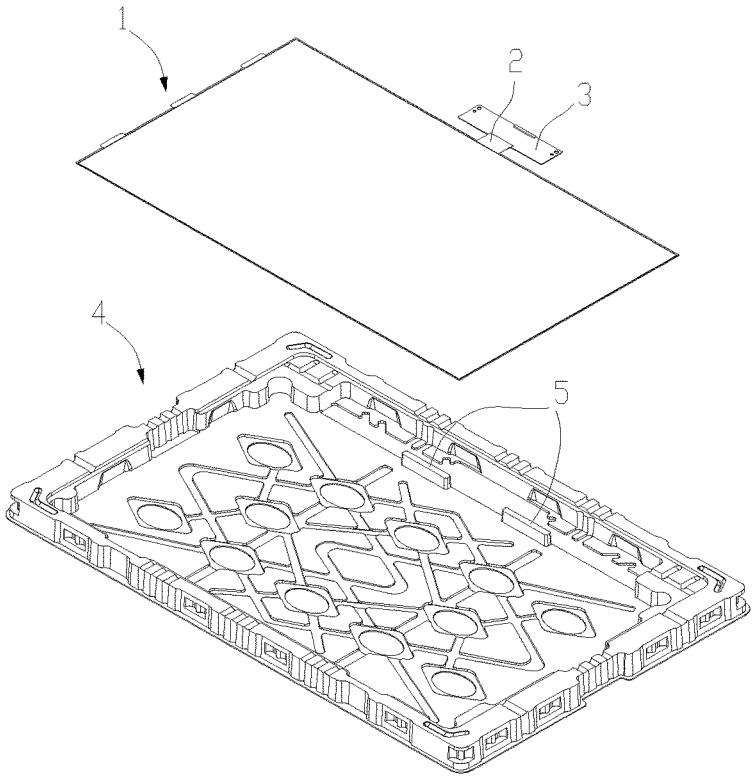
Fig. 1 (Prior art)
FIG. 1 is an exploded view of a conventional open cell LCD panel A and a tray.
Figure 2:
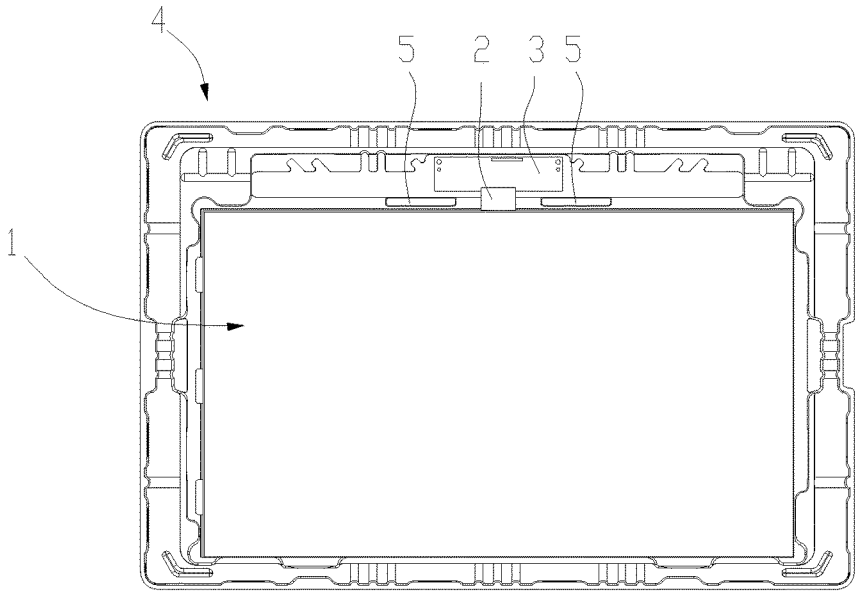
Fig. 2 (Prior art)
FIG. 2 is a front view of an assembly of the conventional open cell LCD panel A and the tray.
Figure 3:
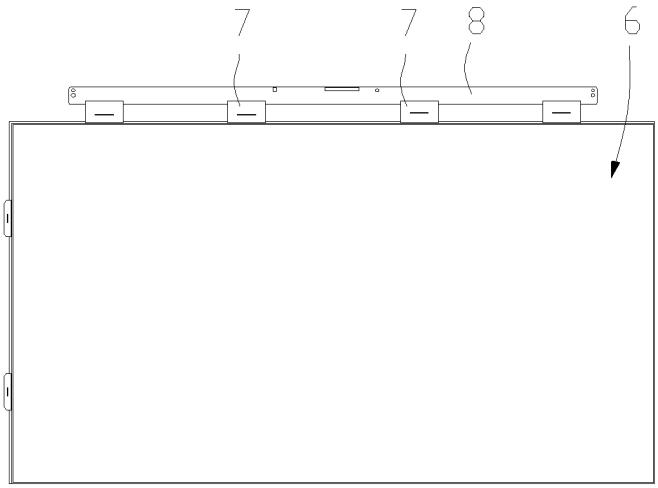
Fig. 3 (Prior art)
FIG. 3 is a schematic diagram showing a structure of a conventional open cell LCD panel B.

According to the present embodiment, the protruding columns (please refer to FIG. 1, FIG. 2) which are integrally formed with the tray are replaced by the detachable locking members 30. In addition, the locking members 30 may be stuck after the open cell LCD panel A 20 is placed and the snap-fit parts 32 may be lifted when the open cell LCD panel A 20 is displaced. Such a tray structure would avoid the impact caused by damages to the open cell LCD panel A 20 during placing and displacing the open cell LCD panel A 20. Moreover, the locking member 30 may be detached when the open cell LCD panel B is positioned. As a result, the tray can be compatible with different types of open cell LCD panels to improve work efficiency and decrease package cost.

Embodiment 2

Figure 7:
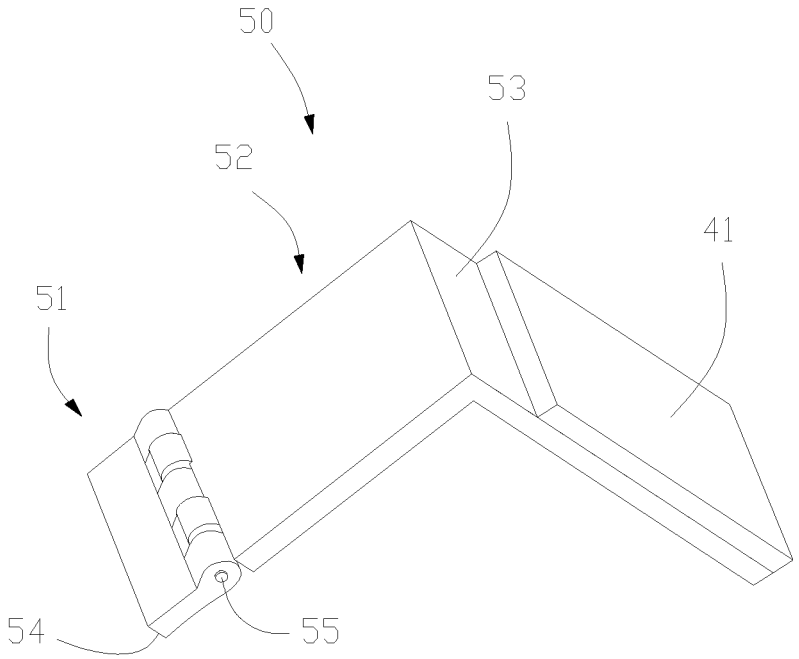
FIG. 7 is a schematic diagram showing a structure of a locking member according to a second embodiment of the present invention.

The present embodiment differs from the first embodiment in that the structure of the locking member is different. Other similarities in structure are not elaborated here. As shown in FIG. 7, a locking member 50 is constituted by a fixed part 51 and a snap-fit part 52 which are mutually hinged to each other. The major difference is that one end of the snap-fit part 52 is hinged to the fixed part 51 through a hinge axis 55. Such a structure would allow the snap-fit part 52 to press the PCB when it rotates downwards since there is not any receiving portion as described in the first embodiment to limit the snap-fit part 52. Hence, the length of the snap portion 53 of the snap-fit part 52 may be designed long enough such that the end of the snap portion 53 will be inserted to the bottom of the tray rather than press the PCB. Similarly, an anti-static buffer sheet 41 is disposed on an outer surface of the snap portion 53, and a side 54 of the fixed part 51 is coated with adhesive to allow the locking member 50 be stuck to an inner wall of the main body of tray.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A tray having limiting structures for positioning an open cell liquid crystal display panel, the open cell liquid crystal panel being connected to a printed circuit board through a chip on film (COF), the tray comprising a main body of tray, the main body of tray having a recess for positioning the open cell liquid crystal display panel, the main body of tray further comprising locking members, each of the locking members being constituted by a fixed part connecting to the main body of tray and a snap-fit part flexibly connecting to the fixed part, wherein one end of the fixed part is fixedly connected to an inner wall of the main body of tray through adhesive, and the snap-fit part comprises a connection portion and a snap portion that are integrally connected to each other and angled to each other, and wherein at least two of the locking members are engaged in gaps between the printed circuit board and the open cell liquid crystal display panels disposed on a liquid crystal box, wherein the fixed part comprises a fixed portion and a receiving portion, the fixed portion and the receiving portion are integrally formed and in a shape of a step, the snap-fit part is hinged to the step, and the snap-fit part rotates towards the receiving portion and finally adheres to a surface of the receiving portion.

2. The tray having limiting structures as claimed in claim 1, wherein the snap-fit part is hinged to the fixed part.

3. The tray having limiting structures as claimed in claim 2, wherein opposite ends of the snap-fit part and the fixed part are staggeredly hinged, a hinge hole is disposed in the plug portion, and a hinge axis is inserted into the hinge hole.

4. The tray having limiting structures as claimed in claim 1, wherein an anti-static buffer sheet is disposed on an outer surface of the snap portion.

5. The tray having limiting structures as claimed in claim 1, wherein anti-static buffer sheets are disposed on inner side walls of the main body of tray which is connected to the liquid crystal box.

* * * * *